US005282427A

United States Patent [19]

Steinhilber

[11] Patent Number: 5,282,427

[45] Date of Patent: Feb. 1, 1994

[54] DEVICE FOR FASTENING A VERTICAL SUPPORT COLUMN TO AN ARTICLE OF FURNITURE

[76] Inventor: Helmut Steinhilber, Sonnenbergstrasse 40, CH-6052 Hergiswil, Switzerland

[21] Appl. No.: 699,630

[22] Filed: May 15, 1991

[30] Foreign Application Priority Data

May 25, 1990 [DE] Fed. Rep. of Germany ..... 4016945
Oct. 5, 1990 [EP] European Pat. Off. ..... 90119156.9

[51] Int. Cl.[5] ..... A47B 57/00
[52] U.S. Cl. ..... 108/97; 108/42; 108/152
[58] Field of Search ..... 108/42, 152, 97, 92, 108/98, 49, 108; 248/447.2, 454

[56] References Cited

U.S. PATENT DOCUMENTS 602,708 4/1898 Siegfried ..... 108/97
2,633,996 4/1953 Litchfield ..... 108/97 X
2,709,563 5/1955 Starkey ..... 108/97 X

FOREIGN PATENT DOCUMENTS 48120 12/1933 Denmark ..... 108/97

*Primary Examiner*—Jose V. Chen
*Attorney, Agent, or Firm*—Irvine A. Lavine

[57] ABSTRACT

To fasten a vertical support column (14) for example of a stand-up desk (16, 18) to an article of furniture, for example a writing desk (10, 12), textile adhesive closures (22, 24) are used. Support column (14) is fastened to desktop (10) of the desk by a textile adhesive closure (22, 24). Another textile adhesive closure can serve as a second fastening point to prevent support column (14) from tilting.

28 Claims, 8 Drawing Sheets

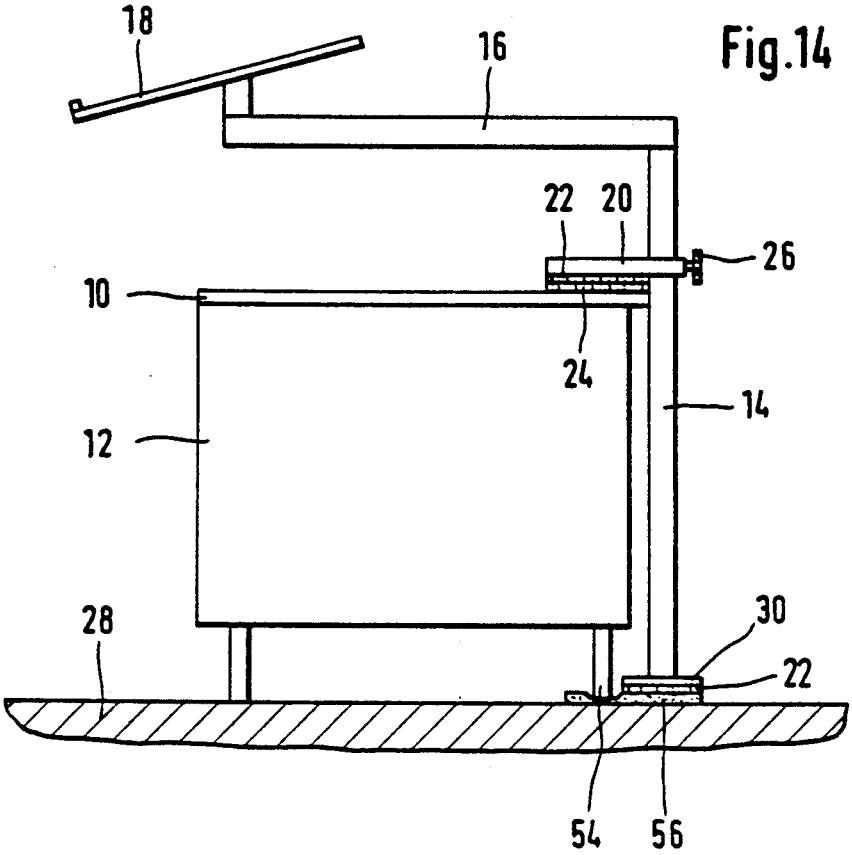
Fig.14
Fig.15
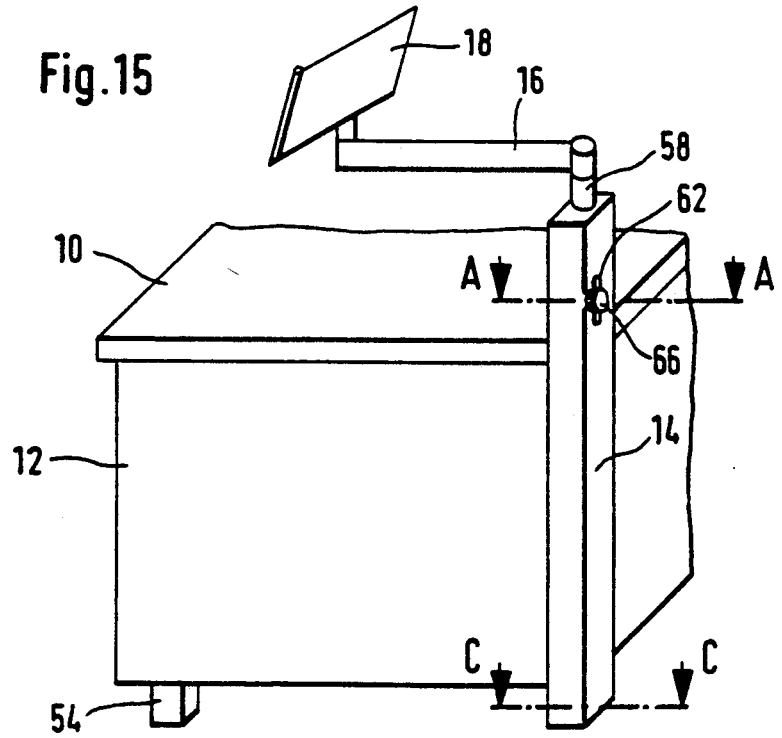

DEVICE FOR FASTENING A VERTICAL SUPPORT COLUMN TO AN ARTICLE OF FURNITURE

The invention relates to a device for fastening a vertical support column for a loadable panel, to an article of furniture.

Loadable panels are mounted by means of vertical support columns on articles of furniture as supplementary work panels, storage panels, and the like for various purposes. Especially in the case of office furniture, preferably desks, such panels are used as telephone supports or CRT supports. It is also known to use such panels as stand-up desk tops. The vertical support columns which bear these loadable panels, are fastened in a wide variety of ways to the corresponding article of furniture.

DE-PS 553 555 teaches fastening a vertical support column for a pivotable support arm of a bookshelf by means of clamps to the top of a desk. For this type of fastening, a freely projecting top is required which the clamps can grip. This is not the case in all articles of furniture.

Fastening by means of clamps to the top of the desk can accept only a small tilting moment affecting the vertical support column. This fastening is therefore not suited for those cases in which a high tilting moment affects the support column because of a higher load on the panel and a longer support arm for said panel.

U.S. Pat. No. 3,232,249 describes the fastening of vertical support columns which bear a desktop by means of two clips screwed to the side wall of an article of furniture. Fastening by means of clips assumes a suitable side wall of the article of furniture to which to screw the clips. Screwing the clips results in damage to the article of furniture, which remains visible should the vertical support column be removed.

DE-PS 37 30 482 teaches a vertical support column which supports the top of a stand-up desk. The support column is screwed to the leg of a writing desk. Here again, a suitably accessible leg to which to screw the support column is necessary. The leg of the desk must have matching holes for the screws, which adversely affect the appearance and may have to be made by a technician using suitable tools if retrofitted.

DE-PS 37 40 953 teaches the fastening of a vertical support column of a stand-up desk to a writing desk, with the writing desk being placed on a floor panel at the lower end of the support column and the support column being tensioned by a horizontally projecting tensioning arm beneath the top of the desk. Engagement of the tensioning arm requires that the desk have a projecting top. This fastening means is therefore not suitable for just any article of furniture. The grip of the tensioning arm on the underside of the desktop has only limited strength.

DE-GM 87 16 686 teaches fastening the support column of a CRT support arm in similar fashion to a desk. Here again the desk is placed on a floor panel at the lower end of the support column. A mounting plate projecting horizontally from the support column is screwed at the top to the top of the desk. As a result, the desktop is damaged.

The goal of the invention is to provide a fastening means for a vertical support column which is especially simple, loadable, and can be removed again without permanent damage to the article of furniture, said fastening means being largely independent of the shape of the article of furniture.

This goal is achieved by a device of the species recited at the outset according to the invention by the features of the characterizing clause of claim 1.

Advantageous embodiments of the invention are described in the subclaims.

According to the invention, at least one fabric adhesive closure is used to fasten the vertical support column to the article of furniture. The textile adhesive closure, known of itself, and for which the term "hook and loop fastener" is also used, consists of two parts, a hook part and a hooked part. The hook part consists of a preferably flexible backing with hook-shaped or mushroom-shaped adhesive elements which hook into textile loops or fibers on the hooked part, which preferably likewise has a flexible backing. These adhesive closures can accept very high shearing forces in the closure plane when in the closed state, but can be separated relatively easily from one another at right angles to the closure plane.

According to the invention, the vertical support column, which bears a loadable panel, for example the panel of a telephone support arm or a CRT support arm or the top of a stand-up desk, has a mounting plate which is provided with one part of the textile adhesive closure. The other part of the textile adhesive closure is mounted at a corresponding point on the article of furniture. The mounting plate is preferably mounted on the support column relative to the article of furniture in such fashion that the adhesive closure receives the tilting moment that acts on the support column during loading of the panel, preferably in the shearing direction.

The fastening of part of the adhesive closure to the article of furniture is preferably accomplished using an adhesive or a self-adhesive film which can be removed from the article of furniture without leaving a mark. If the support column is removed from the article of furniture, because the additional loadable panel is no longer required or is to be mounted at another point, the adhesive closure is removed from the article of furniture and the latter then again assumes its unchanged original appearance.

The fastening of the support column to the article of furniture can be accomplished at any point on the article of furniture, noting firstly that the mounting plate can be applied easily to the article of furniture and secondly that the tilting moment acting on the support column places a stress on the adhesive closure which preferably lies in its shear plane.

In an especially versatile embodiment of the invention, the mounting plate is mounted horizontally on the support column and engages with its adhesive closure, a horizontal working surface of the article of furniture. This embodiment is suitable for all manner of tables and also for articles of furniture that are the height of a table, and which as a rule have horizontal tops. Fastening the support column by means of a horizontal mounting plate on a horizontal surface of the article of furniture makes the device largely independent of the shape of the article of furniture. A universal design for the device is therefore suitable for any article of furniture, something which is especially significant for retrofitting existing articles of furniture.

When the panel supported by the support column is loaded, a tilting moment acts on the mounting plate fastened to the desktop by means of the adhesive closure. Hence, although shear forces in the plane of the adhesive closure do not act on the adhesive closure, because when the rigid mounting plate is tilted, the adhesive closure must simultaneously be separated over its entire surface, high adhesive power is achieved relative to such a tilting moment, and hence a stable fastening of the support column. If high tilting loads are expected, for example if the support column holds the desktop of a stand-up desk on a long horizontal outrigger arm, it is advantageous to provide an additional fastening which receives the tilting moment acting on the mounting plate. For this purpose, a fastening means is likewise preferably chosen which can be separated again from the article of furniture without any permanent damage.

If the mounting plate is attached so that it projects horizontally from the support column, the support column passes laterally with respect to the desktop. The support column can therefore be guided downward beyond the desktop so that additional fastening at a second point on the support column at a distance from the mounting plate is possible. The second fastening point can be for example a floor plate mounted on the lower end of the support column, on which the article of furniture is placed, as is known from DE-PS 37 40 953.

In one preferred embodiment of the invention, a textile adhesive closure likewise serves as a second fastening point, said closure being mounted on a support panel provided at the lower end of the support column. The support column can be placed with this support panel on the floor. If the floor is provided with a suitable textile floor covering, the support panel can bear the hook part of the adhesive closure and the textile floor covering itself can serve as the hooked part of the adhesive closure. Otherwise, a floor plate is fastened to the floor and bears the second part of the adhesive closure. If the article of furniture has a substructure with sufficient floor clearance, as is frequently the case for a desk with a pedestal, the support panel with the adhesive closure can also be applied from below to the underside of the article of furniture. Finally, the support panel with the adhesive closure can also be applied to one side wall of the article of furniture, but in this case the distance between the two fastening points should be as long as possible.

To ensure complete, stable hooking of the adhesive closure or closures, it is advantageous to make the distance between the two fastening points of the support columns adjustable. This is especially advantageous for free adaptation of the fastening device to any article of furniture. For this purpose the mounting plate can be mounted in a height-adjustable fashion on the support column. The support panel can also be additionally or solely height-adjustable on the support column.

The support column which passes the working surface of the article of furniture laterally is unfavorable in many applications for reasons of space, for example because it means that two articles of furniture cannot be placed with their tops directly in contact with one another. This can be avoided in an advantageous embodiment by virtue of the fact that the support column has a rectangular cross section and abuts one corner of the desktop with its two legs. The articles of furniture can then be pushed together until the distance between their tops corresponds to the thickness of the legs of the support panel.

If a support column brought out laterally from the article of furniture is perceived as aesthetically unsatisfactory, another embodiment may be used in which the mounting plate is attached horizontally to the lower end of the support column, so that the support column rests on the mounting plate fastened to the desktop by means of the adhesive closure. Since the support column is held only by the mounting plate resting on the desktop, there are no parts that project beyond the edge of the top of the article of furniture, and the article of furniture can be placed immediately thereafter against another article of furniture or against a wall.

In these cases, if the adhesive power of the adhesive closure of the horizontal mounting plate is not sufficient to accept the tilting moment acting on the support column, the mounting plate can be additionally fastened by a mounting angle.

The mounting angle has a horizontal leg that fits over the mounting plate, while the other vertical leg is directed downward and is fastened by means of a textile adhesive closure to the outer edge of the top of the article of furniture. This downwardly directed leg of the mounting angle thus forms the support panel for the second fastening point. When a tilting moment acts on the horizontal mounting plate, the latter forces the mounting angle upward, representing a shear stress on the adhesive closure of the mounting angle located in the vertical plane. The mounting angle thus holds the mounting plate, along with its adhesive closure, to the desktop.

The vertical leg of the mounting angle, which is located on the outer edge of the desktop, projects only slightly beyond this outer edge so that for all practical purposes it does not significantly impede flush joining of the tops of two articles of furniture or prevent the article of furniture being pushed against a wall.

If the mounting plate is located on one side edge of the top of the article of furniture, a mounting angle can be attached to this side edge. If the mounting plate is located at a corner of the desktop, mounting angles can be provided at the two edges that meet in this corner. Which of these choices is selected depends essentially on where the support column is to be located and in which direction the load is primarily applied.

If the mounting plate has its edge flush with the outer edge of the top of the article of furniture, any tilting moment of the mounting plate will act almost exclusively in the vertical plane of the adhesive closure, on the mounting angle. However, if the edge of the mounting plate is at a certain distance from the outer edge of the desktop, a tilting moment of the mounting plate will also act as a lever through the horizontal leg of the mounting angle, exerting a tilting moment on the adhesive closure of the mounting angle, so that its adhesive force is reduced. This can be prevented by the horizontal leg of the mounting angle being fastened to the mounting plate. In the simplest case, the horizontal leg of the mounting angle that fits over the mounting plate is screwed to the mounting plate. An especially attractive design results when the mounting plate has a horizontal insertion slot in its side edge, into which slot the horizontal leg of the mounting angle can be slid. The mounting angle thus becomes invisible and does not have an adverse effect on the appearance of the mounting plate. In addition, the mounting angle can be attached without additional fastening means such as screws or the like.

If the adhesive closure cannot be attached to the outer edge of the desktop, especially when the latter is rounded, a mounting angle can be applied beneath the desktop which likewise has a rectangular cross section. The horizontal leg of the fastening angle fits beneath the desktop while the other leg projects vertically upward and externally abuts the outer edge of the desktop. This vertical leg of the mounting angle bears one part of the adhesive closure to which the vertically downwardly directed leg of the mounting angle, bearing the other part of the adhesive closure, is attached. The mounting angle and the fastening angle thus fit around the edge of the desktop and the mounting plate that is attached to the desktop like a clip.

If the support column is held on the one hand by means of the textile adhesive closure to the desktop and on the other hand by its lower end to the floor, a load on the panel, which is loadable and attached to a horizontal arm, can result in a tilting moment around the lower base point of the support column which rests on the floor, so that the article of furniture, for example a desk, will be displaced if its weight is not too great. To avoid this, a connection can be provided between the lower end of the support column and one leg of the article of furniture, preventing mutual displacement and hence a pushing away of the article of furniture. This connection can consist of a mat on which firstly the support column is placed and secondly the leg of the article of furniture is placed. The support column can be fastened to the mat by means of a hook and loop fastener, while the leg of the article of furniture is preferably kept from shifting on the mat by virtue of the fact that it penetrates the compressible material of the mat under the weight of the article of furniture. The mat can also in turn be fastened to the floor by means of a hook and loop fastener.

It is also possible for the support panel attached to the lower end of the support column to extend as far as the closest leg of the article of furniture and to have a cutout into which the leg can be inserted. As a result, mutual displacement of the support column and article of furniture is eliminated.

Finally, a soft mat can be placed beneath at least one leg of the article of furniture, into which mat the leg penetrates under its own weight, so that it cannot be displaced relative to the mat. The mat in turn is fastened to the floor by means of a hook and loop fastener.

The device according to the invention is suitable in one and the same design or in several variations, for fastening support columns to any article of furniture, especially to any type of writing desk. Consequently, the device is primarily suited for retrofitting existing, desks for example with telephone support arms, CRT arms, or stand-up desktops. Fastening is simple to use so that it can be applied even by an individual not skilled in the art without any problems. Except for gluing the adhesive closure, no action on the article of furniture is required. The adhesive closure can be removed again without a trace from the furniture so that after possible removal of the support column, no permanent damage is left on the article of furniture. The fastening device is extremely simple in design and is therefore cost-effective to manufacture.

The invention will now be described in greater detail with reference to the embodiments shown in the drawing.

FIG. 14 is a side view of an eighth embodiment of the invention;

FIG. 15 is a perspective view of a ninth embodiment of the invention;

Figure 1:
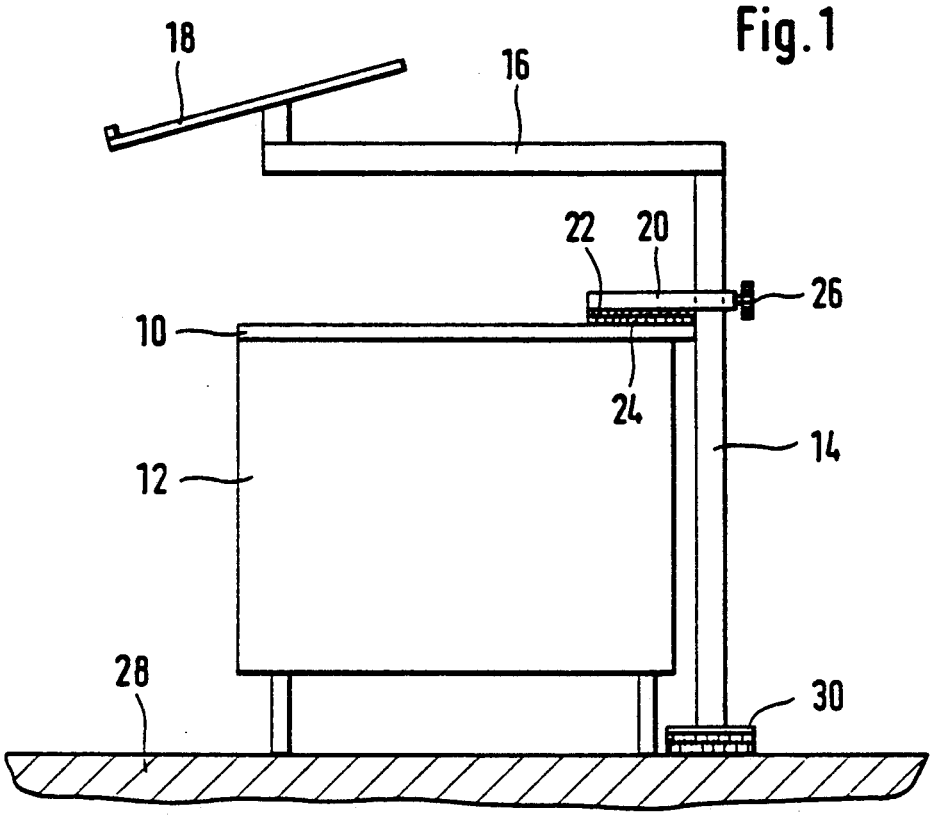
FIG. 1 is a side view of a first embodiment of the invention.
Figure 2:
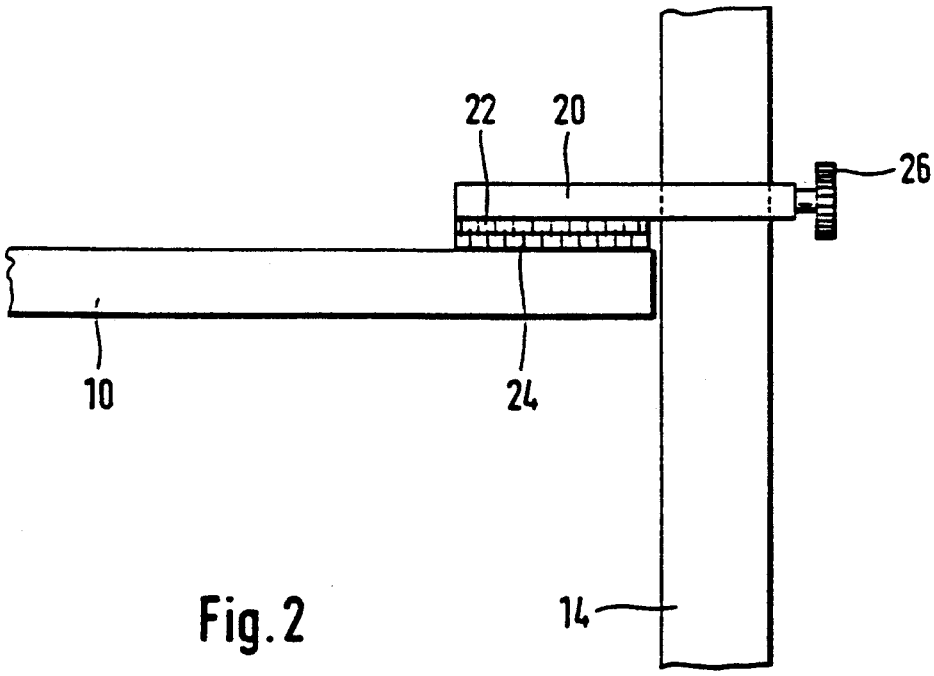
FIG. 2 shows the upper fastening point of the embodiment shown in FIG. 1, enlarged.

The drawing shows the invention on the basis of the fastening of a stand-up desk to a writing desk. The writing desk has a top 10 and at least one pedestal 12. The stand-up desk has a vertical support column 14 to be fastened to the writing desk, with a horizontal support arm 16 being mounted preferably swivelably to its upper end projecting above top 10 of the desk. The loadable stand-up desk top 18 is located at the free end of support arm 16.

In the embodiments shown in FIGS. 1 to 7, correspondingly, a mounting plate 20 is displaceably mounted on vertical support column 14. Mounting plate 20 projects horizontally from support column 14 standing laterally next to the writing desk, above top 10 of the desk. To the underside of mounting plate 20, facing top 10 and parallel thereto, there is flush-mounted one part 22, for example the hook part, of a textile adhesive closure, for example by gluing. The other part 24 of the adhesive closure, for example the hooked part, is glued over the same surface area beneath mounting plate 20, at the top, on desktop 10. Mounting plate 20 may be clamped tightly to support column 14 by means of a knurled screw 26.

In the embodiment in FIG. 1, vertical support column 14 stands with its lower end on floor 28. At its lower end, resting on floor 28, a horizontal support panel 30 is fastened is attached to support panel 14. Support panel 30 is fastened by means of a textile adhesive closure to floor 28, as will be described in greater detail below with reference to FIGS. 3 to 5.

To fasten the stand-up desk to the writing desk in the embodiment in FIG. 1, first of all support column 14 is placed next to the desk on floor 28 so that the lower end of support column 14 is attached by support panel 30 by means of the adhesive closure to floor 28. Then mounting plate 20 is lowered to top 10 of the writing desk so that adhesive closure 22, 24 closes. Thus mounting plate 20 is attached to top 10 of the desk so that in this embodiment, clamping of mounting plate 20 by means of a knurled screw 26 is not required of itself.

When desktop 18 is loaded when using the stand-up desk, for example if the user leans on this desktop, a tilting moment acts on support column 14 through support arm 16. If the support arm projects over the desktop, as shown in FIG. 1, the fastening by means of mounting plate 20 represents the pivot of the tilting moment acting on support column 14. The adhesive closure that holds support panel 30 to floor 28 prevents the lower end of support column 14 from swinging away under the influence of this moment, with the adhesive closure being loaded in its plane, in which it can accept the maximum shear moment.

If support arm 16, contrary to what is shown in FIG. 1, projects away from the desktop, a tilting moment with support panel 30 as the pivot acts on support column 14 when desk panel 18 is loaded. At the level of desktop 10, this tilting moment attempts to swing support column 14 away from the desktop, so that adhesive closure 22, 24 is likewise loaded in its plane in which it can accept the maximum shear force.

Figure 3:
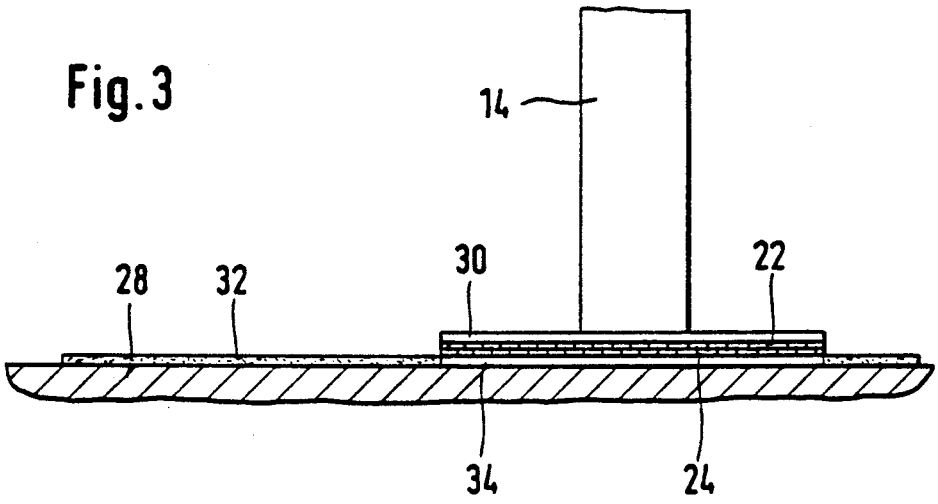
FIG. 3 to 5 show various variations on the lower fastening point of the embodiment shown in FIG. 1.

Fastening of support panel 30 to floor 28 by means of a textile adhesive closure is advantageously directed depending on the nature of floor 28. If floor 28 is covered by carpeting 32, as shown in FIG. 3, a floor panel 34 is placed on carpet 32 beneath support panel 30. On the underside of support panel 30, one part 22 of the adhesive closure, and on the top of floor plate 34, the other part 24 of the adhesive closure, are glued. In order to prevent floor panel 34 from sliding on carpeting 32, the underside of floor panel 34 is filled in the manner of a brush with fine wires, as is known for example from carding in textiles. These wires penetrate the nap of carpeting 32 and hold floor plate 34 secure against shear forces.

Figure 4:
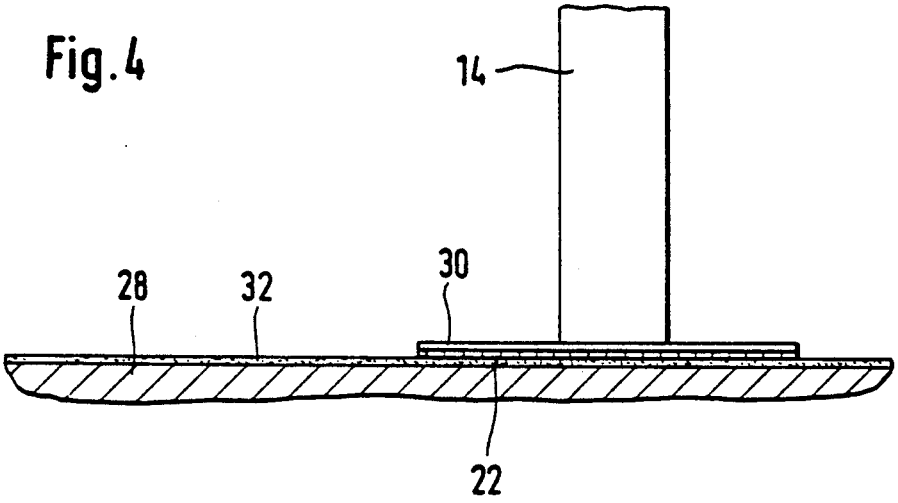

With suitable carpeting 32, especially for example with velour flooring or looped fabric, support panel 30 can be placed with hook part 22 of the adhesive closure mounted on its underside, directly on carpeting 32, as shown in FIG. 4. Hook part 22 of the adhesive closure then hooks into carpeting 32, which thus serves as the hooked part of the adhesive closure.

Figure 5:
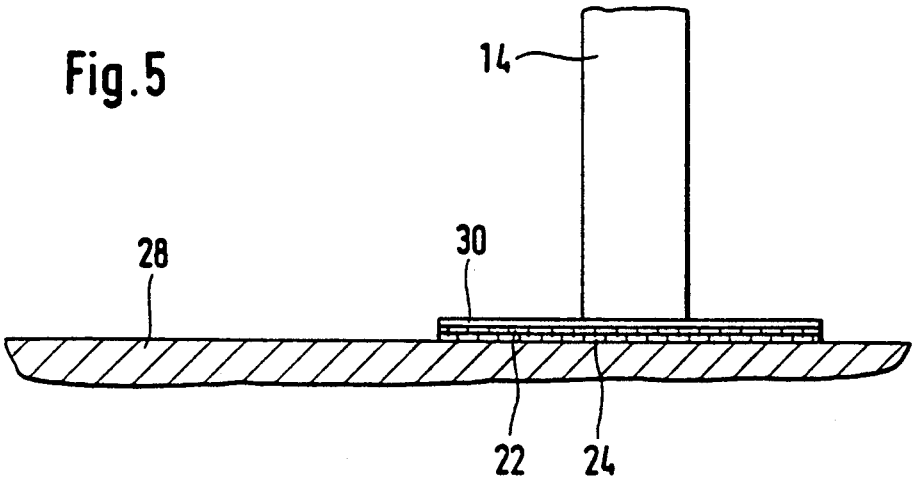

For other floors 28 with solid surfaces, as for example parquet floors or plastic flooring, the second part 24 of the adhesive closure can be glued directly to floor 28, as shown in FIG. 5.

Figure 6:
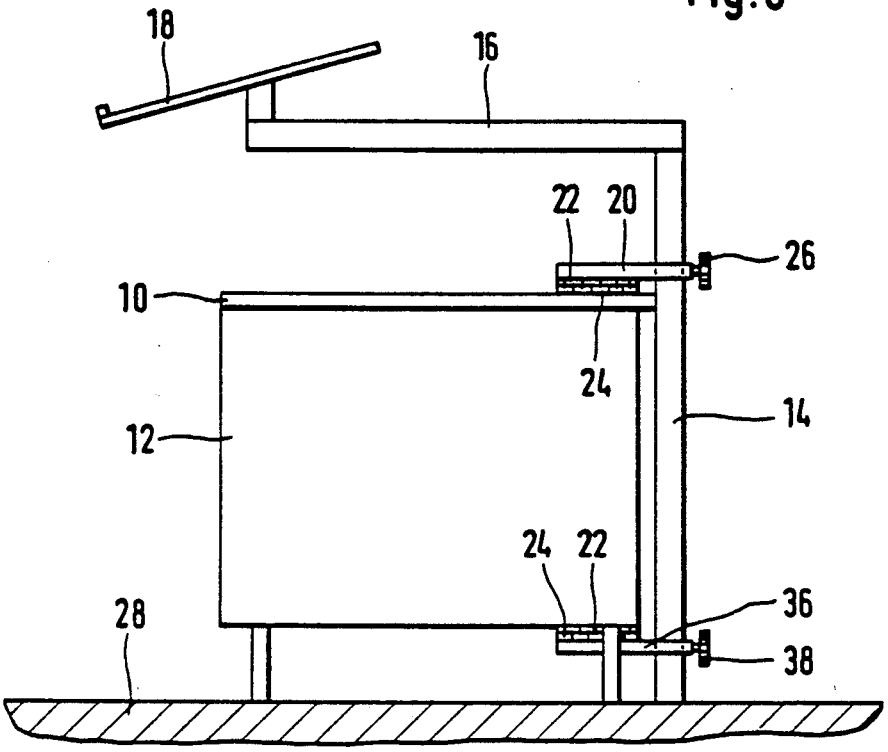
FIG. 6 is a side view of a second embodiment of the invention.

FIG. 6 shows a second embodiment. In this embodiment a support panel 36 is displaceably and adjustably fastenable to the lower end of vertical support column 14 by means of a knurled screw 38. Support panel 36 extends horizontally from support column 14 beneath pedestal 12 of the desk. On the upper surface of support panel 36, which is parallel to the underside of pedestal 12, one part 22 of an adhesive closure is glued flush. The other part 24 of the adhesive closure is glued to an equal area, opposite support panel 36, on the underside of pedestal 12.

To mount the stand-up desk according to FIG. 6, support column 14 is initially placed next to the writing desk on floor 28. Then mounting plate 20 is lowered from above onto desktop 10 and fastened by means of adhesive closure 22, 24. Then support panel 36 is guided from below against pedestal 12 and fastened to the latter by means of adhesive closure 22, 24. Since both mounting plate 20 and support panel 36 are held by respective adhesive closures 22 and 24, knurled screws 26 and 38 are not absolutely necessary of themselves. In this embodiment also, the fastening points formed by the two adhesive closures 22 and 24 accept the tilting moments that act on support column 14. Depending on the arrangement of support arm 16 in the direction of the acting tilting moment, adhesive closure 22, 24 of mounting plate 20 is the pivot for the tilting moment and adhesive closure 22, 24 of support panel 36 receives the tilting moment or, vice versa, support panel 36 acts as a pivot and mounting plate 20 accepts the tilting moment with its adhesive closure 22, 24.

Figure 7:
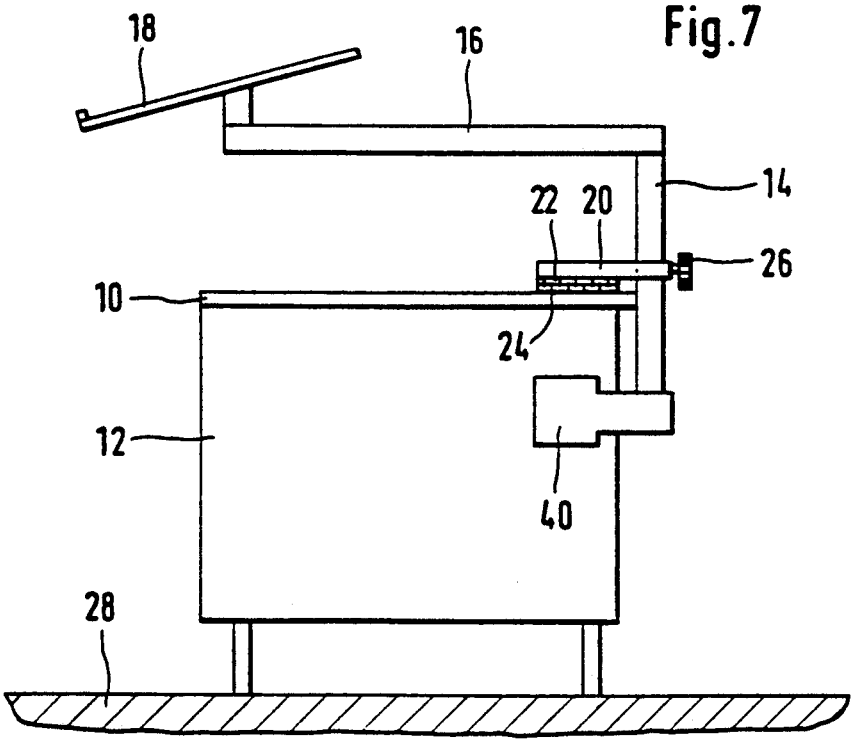
FIG. 7 is a side view of a third embodiment of the invention.

FIG. 7 shows a third embodiment. This embodiment differs from those described above in that support column 14 is not brought down as far as floor 28 and does not stand on floor 28.

In the embodiment shown in FIG. 7, the lower end of support column 14 extends downward into the area of pedestal 12. At the lower end of support column 14, a support panel 40 is attached and projects horizontally from support arm 14, which has a surface facing the vertical side wall of pedestal 12 and on which a part of a textile adhesive closure is mounted. The other part of the adhesive closure is glued to the corresponding area on the side wall of pedestal 12.

To fasten the stand-up desk, the latter is initially fastened with support panel 40 to the side wall of pedestal 12 and then mounting plate 20 is lowered to top 10 of the desk and fastened by means of adhesive closure 22, 24.

In this embodiment also, the tilting moment exerted on support column 14 either acts together with mounting plate 20 as a pivot, whereby support panel 40 accepts the tilting moment with its adhesive closure which is subjected to shear, or support panel 40 acts as the pivot, so that mounting plate 20 accepts the tilting moment with its adhesive closure 22, 24 under shear stress.

Figure 8:
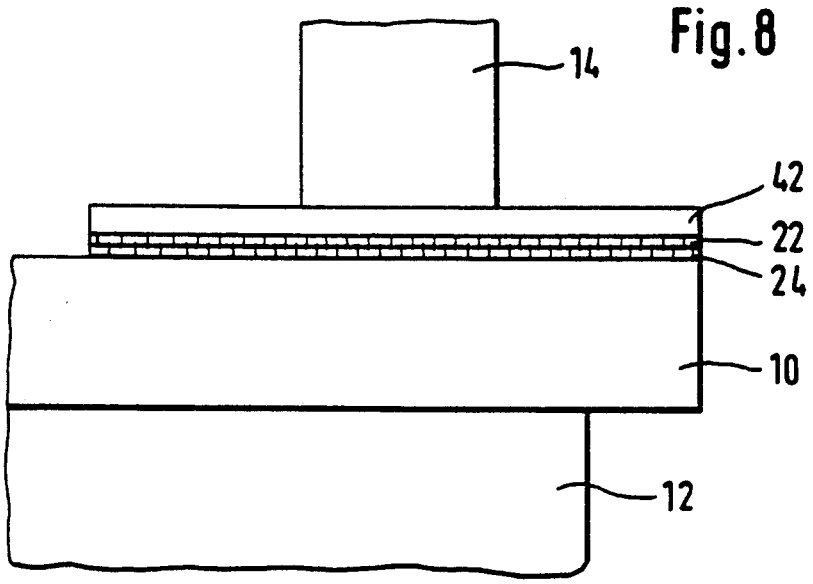
FIG. 8 is a side view of a fourth embodiment of the invention.

FIG. 8 shows a fourth embodiment. In this embodiment, support column 14 is mounted centrally on mounting plate 42 which is fastened by means of adhesive closure 22, 24 on top 10. Thus, there are no parts that project above the outer edge of top 10. The article of furniture can therefore be placed, together with its top 10, immediately afterward against another article of furniture or against a wall.

When a tilting moment acts on support column 14, it results in a tilting moment acting on mounting plate 42 with the corresponding side edge of mounting plate 42 as a tilting axis. Since adhesive closure 22, 24 has to be separated simultaneously over its entire surface during such a tilting of mounting plate 42, there is a high adhesive force against such a tilting moment.

Figure 9:
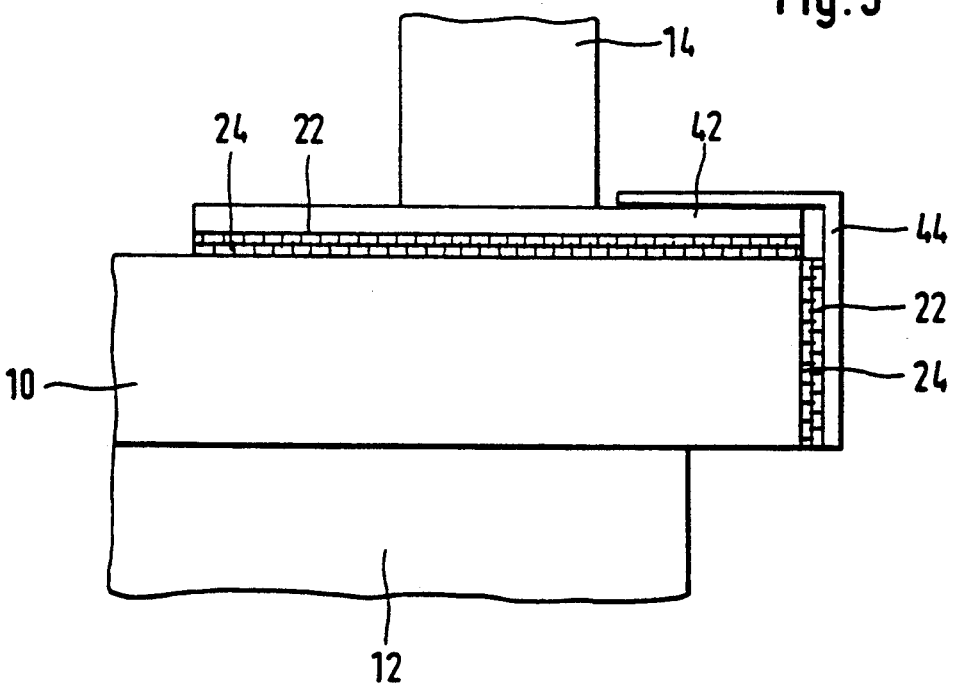
FIG. 9 is a side view of a fifth embodiment of the invention.

If this adhesive force is not sufficient, then according to the embodiment shown in FIG. 9, a mounting angle 44 in the form of a rectangular (in cross section) rail can be used, fastened by its vertical leg by means of a strip-shaped adhesive closure 22, 24 to the outer edge of desktop 10 and gripping mounting plate 42 with its horizontal leg.

A mounting 44 can be provided if mounting plate 42 is located on only on edge of desktop 10. If mounting plate 42 is placed on one corner of desktop 10, a mounting angle 44 can be also provided at each of the two edges that meet at the corner. In this case, the two horizontal legs of retaining angle 44 are beveled at the corner, preferably so that they abut one another in a miter joint.

If mounting plate 42 rests flush with its edge on the outer edge of desktop 10, as shown in FIG. 9, it will be readily apparent that a tilting moment acting on mounting plate 42, with the edge opposite mounting angle 44 of mounting plate 42 as the tilting edge, will stress mounting angle 44 essentially in the plane of adhesive closure 22, 24. Adhesive closure 22, 24 has a high retaining force in its plane against this shear stress. However, if mounting plate 42 is at a certain distance from the outer edge of desktop 10, a tilting moment of this kind acting on mounting plate 42 will push the horizontal leg of mounting angle 44 upward so that a tilting moment (clockwise in FIG. 9) acts on mounting angle 44, which tries to lever mounting angle 44 up and off the edge of desktop 10. Adhesive closure 22, 24 has a reduced adhesive force against such a tilting moment. In order to prevent this kind of levering of mounting angle 44, the horizontal leg of mounting angle 44 can be fastened in very simple fashion to mounting plate 42, i.e. it can be screwed to it.

Figure 10:
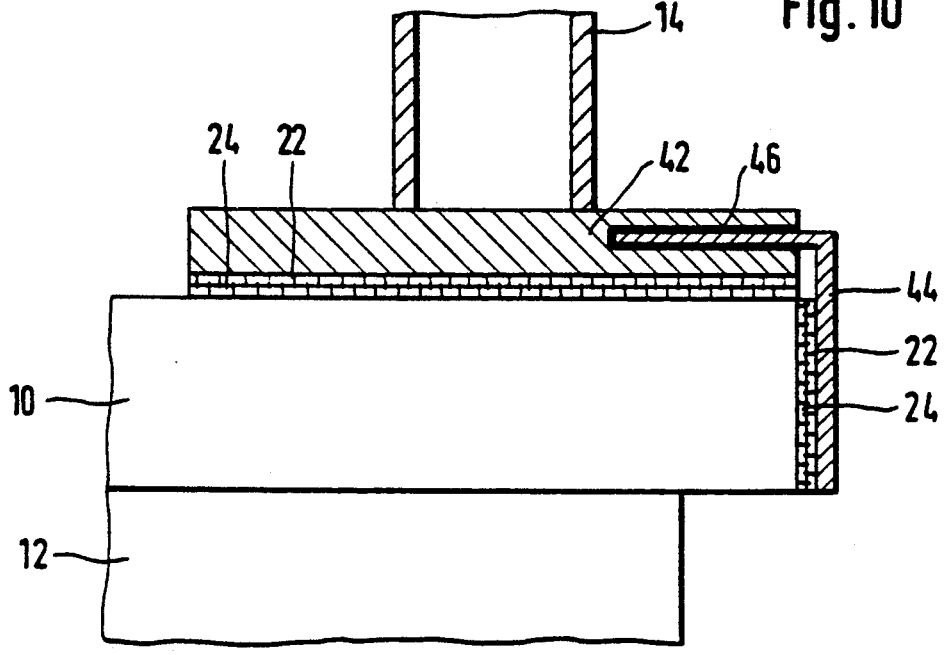
FIG. 10 is a vertical section through a sixth embodiment of the invention.

According to the embodiment shown in FIG. 10, levering of mounting angle 44 is prevented by the fact that the horizontal leg of mounting angle 44 is inserted into a horizontal insertion slot 46 in the side edge of mounting plate 42. This sliding of mounting angle 44 into insertion slot 46, without additional fastening means, prevents a tilting moment acting on mounting plate 42, counterclockwise in FIG. 10, resulting in a tilting moment acting clockwise on mounting angle 44. In addition, mounting angle 44 in this embodiment remains practically invisible on the top of the desk.

Figure 11:
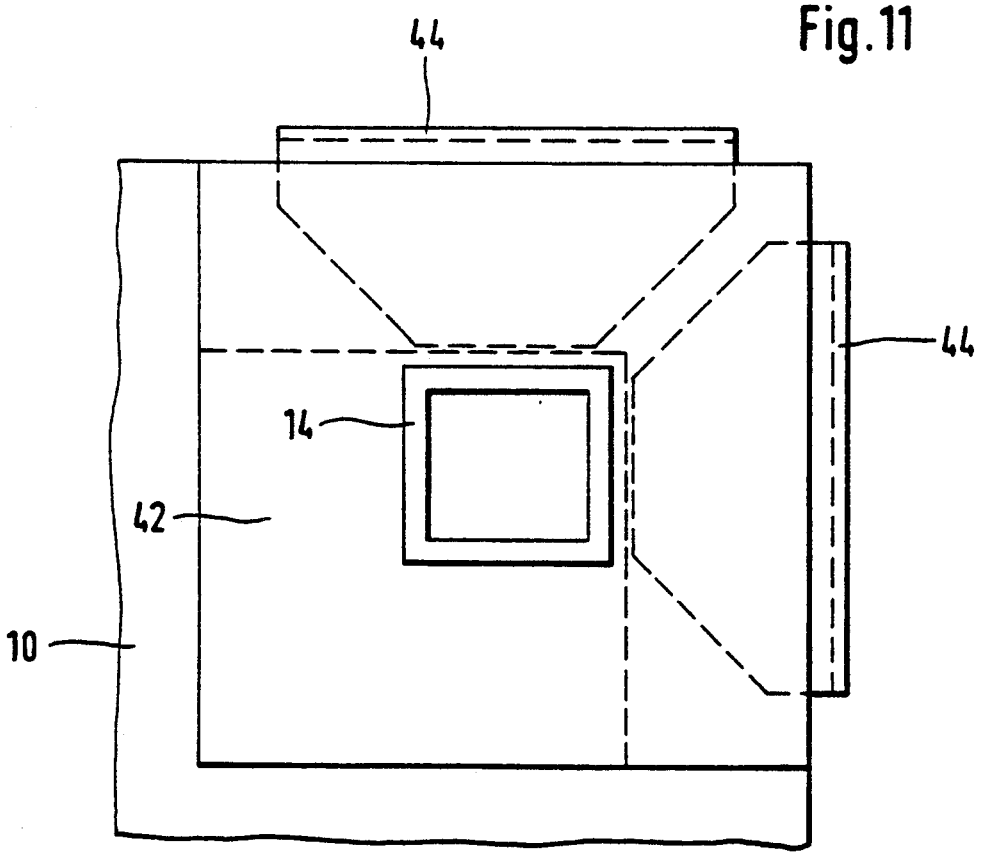
FIG. 11 is a top view of the embodiment shown in FIG. 10.

FIG. 11 shows a top view of an embodiment with two mounting angles 44 that hold two edges of mounting plate 42 placed on one corner of desktop 10.

In the embodiments shown in FIGS. 9 and 10, mounting plate 42 is initially placed on desktop 10 and its adhesive closure 22, 24 is squeezed together tightly so that it grips stably. Then mounting angle 44 is pushed on from the side, with the horizontal leg being guided by pressure directed perpendicularly against desktop 10 until the vertical leg of mounting angle 44 abuts the side edge of desktop 10 and its adhesive closure 22, 24 can be pressed together with force. In this manner, firm adhesion under pressure of the adhesive closures 22, 24 of mounting plate 42 and of mounting angle 44 or of the two mounting angles 44, arranged in mutually perpendicular planes, is possible.

Figure 12:
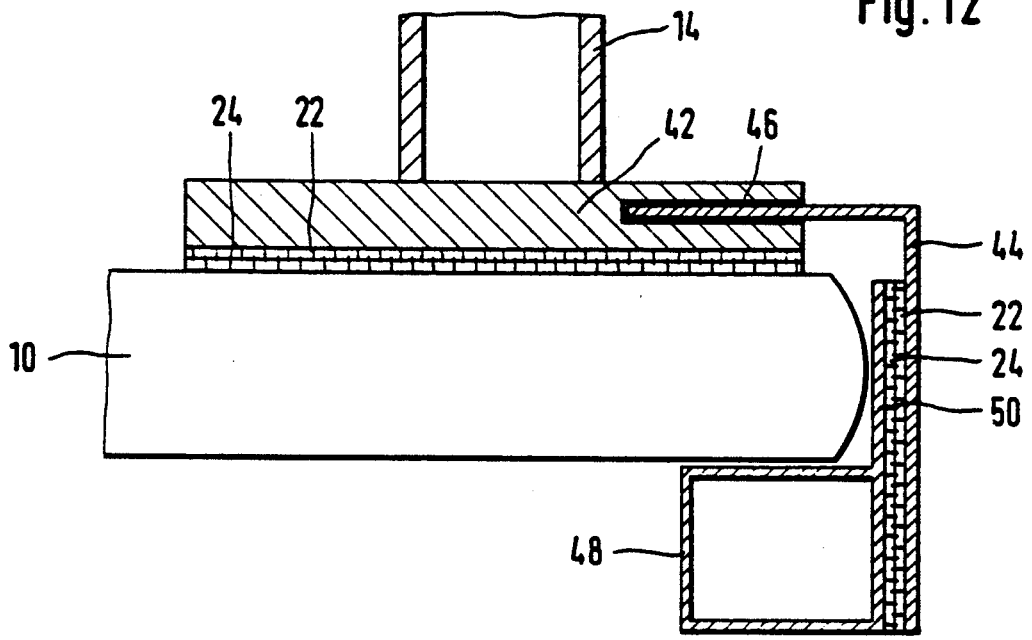
FIG. 12 is a vertical section through a seventh embodiment of the invention.

If desktop 10 has a rounded outer edge, fastening part 24 of the adhesive closure to the outer edge of desktop 10 is difficult. In this case, according to the embodiment in FIG. 12, a mounting angle may be used which has the shape of a rectangular section. One leg 48, which for stability reasons is advantageously made in a hollow rectangular shape, is applied to the underside of desktop 10. The other leg 50 of the mounting angle projects vertically upward and abuts the outer edge of desktop 10. Hooked part 24 of the adhesive closure is applied to the outside of this vertical leg 50. If mounting angle 44 has hook part 22 of its vertically downwardly directed leg pressed against leg 50 of the mounting angle, mounting angle 44 and the fastening angle are firmly connected together by the adhesive closure and enclose mounting plate 42 and desktop 10 between them like a clip. Fastening horizontal leg 48 of the mounting angle to desktop 10 is not necessary of itself. For simpler assembly, horizontal leg 48 can be easily attached to the underside of desktop 10, for example by means of a strip which is gummed on both sides.

Figure 13:
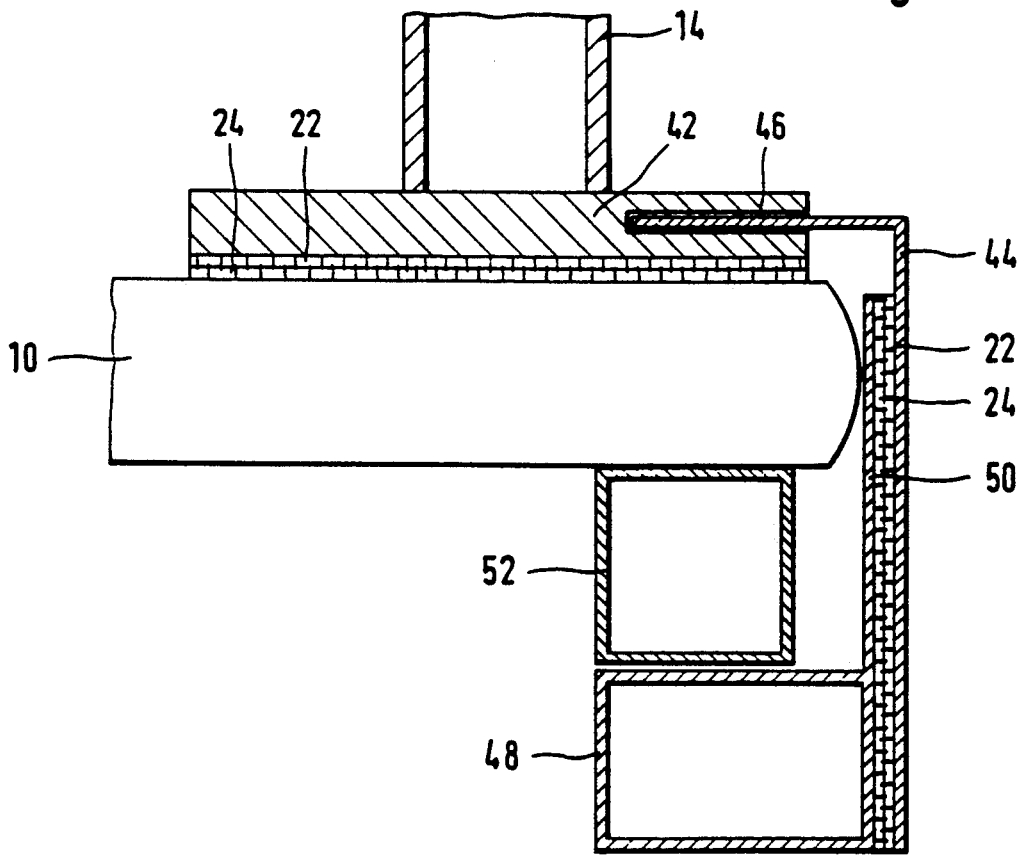
FIG. 13 is a variation on the embodiment shown in FIG. 12.
Figure 16:
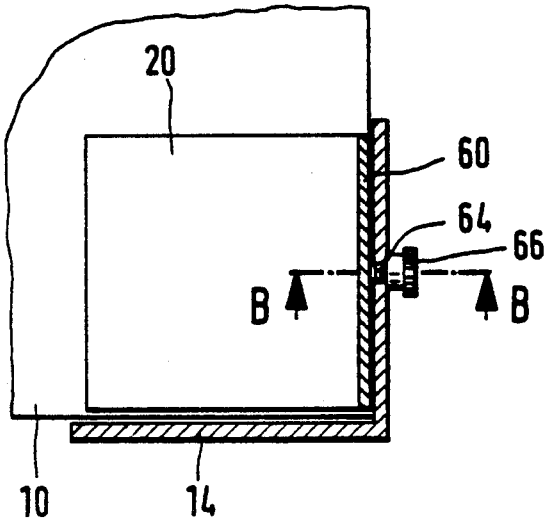
FIG. 16 is a section along line A—A in FIG. 15.
Figure 17:
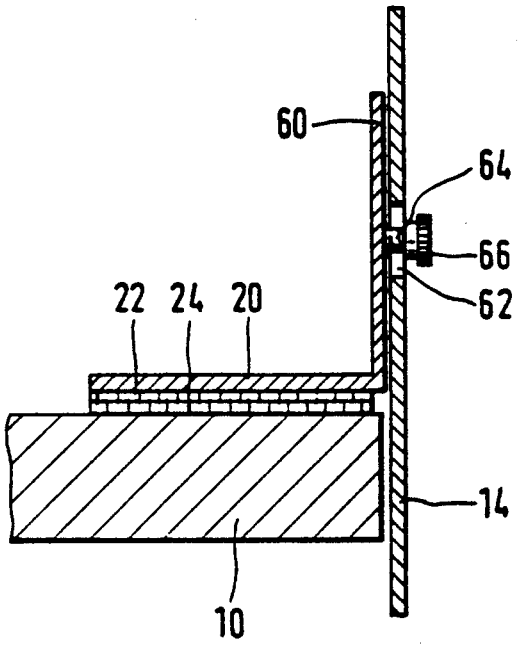
FIG. 17 is a section along line B—B in FIG. 16.
Figure 18:
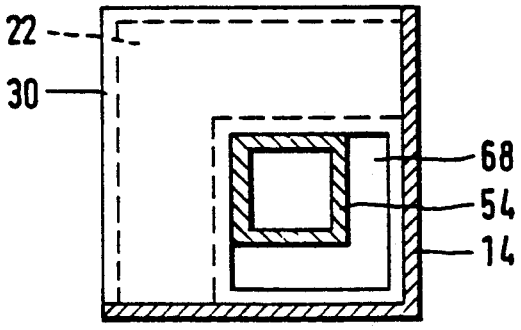
FIG. 18 is a section along line C—C in FIG. 15.

Desks and worktables frequently have a tubular steel frame 52 beneath desktop 10 which projects slightly beyond top 10. In this case, the modified embodiment shown in FIG. 13 may be used. Horizontal leg 48 of the mounting angle in this case engages beneath steel tube frame 52. Vertical leg 50 of the fastening angle is then made slightly longer so that extends beyond steel tube frame 52 as far as the outer edge of desktop 10. As FIG. 13 shows, this permits fastening of mounting angle 44 by means of textile adhesive closure 22, 24 despite the rounded outer edge of desktop 10 and despite inwardly staggered steel tubular frame 52.

If the desk has sufficient weight it will stand on floor 28 without shifting. The high stability of the fastening of mounting plate 20 on desktop 10 and of support panel 30 on floor 28 by means of the textile adhesive closures in the case of a lightweight desk, however, can result in a situation in which when stand-up desk panel 18 is loaded, a tilting moment can act through the lever effect of support arm 16 on support column 14 around the lower leg point which acts as the pivot. This tilting moment can result in displacement of the desk, so that the latter is pushed away from the lower leg point of support column 14 by which the latter is fastened to floor 28.

In order to avoid this pushing away, the lower end of support column 14 can be connected to the closest leg 54 of the desk so that the distance between them is maintained and the desk cannot be forced away from the leg point of support column 14. In the embodiment shown in FIG. 14, a mat 56 is provided which rests on floor 28 and extends from support panel 30 of support panel 14 to a point beneath the closest leg 54 of the desk. Support panel 30 is fastened by means of its textile adhesive closure 22 to mat 56. Mat 56 consists of a compressible material so that leg 54 penetrates mat 56 under the weight of the desk, as shown in FIG. 14, and is not displaceable on mat 56.

The mat can consist for example of a felt material so that hook part 22 of the adhesive closure of support panel 30 can hook directly into mat 56. Mat 56 can also be made of a soft plastic material. In this case, to fasten support panel 30 to mat 56, hooked part 24 of the textile adhesive closure is applied. Mat 56 in turn is fastened to floor 28 preferably by means of a textile adhesive closure. For this purpose, depending on the nature of floor 28, the same fastening opportunities present themselves as described above with reference to FIGS. 3 to 5 for fastening support panel 30 to floor 28.

Instead of a mat 56 that extends from support panel 30 to leg 54, a mat 56 can also be used which is simply placed beneath leg 54 of the desk. Support column 14 in this case is attached by support panel 30 in the manner described in conjunction with FIG. 1, directly to floor 28. In this case also, as a result of the fastening of support panel 30 to floor 28 and the fastening of leg 54 by means of mat 56 to floor 28, the distance between support column 14 and the desk is maintained without sliding.

FIGS. 15 to 18 show another embodiment. In this embodiment, support column 14 of the stand-up desk is guided laterally next to desktop 10 of the desk down to floor 28. In order to make it possible, despite support columns 14, to push two desks together so that their tops 10 are as close as possible to one another, support column 14 consists of a rectangular section and is placed at one corner of desktop 10. The two section legs of support column 14 each abut one outer edge of desktop 10. Support column 14 thus projects only by the thickness of the material composing the leg of the support column section, above the outer contour of desktop 10. Thus two tables can have their tops 10 pushed together to a distance that corresponds to the thickness of the material composing the legs of support column 14.

For pivotable fastening of support arm 16, the upper end of the angle section of support column 14 is sealed off by a cover panel on which a tubular stub 58 is welded, to which support arm 16 is pivotably mounted.

Mounting plate 20 is designed as a rectangular panel whose side lengths correspond to the widths of the section legs of support column 14. Mounting plate 20 is held in this way in the angular section of support column 14. Mounting plate 20 has a leg 60 that projects upward at right angles and internally abuts a section leg of support column 14. A threaded pin 64 is mounted on this leg 60, said pin projecting outward through a vertical elongated hole 62 of the section leg of support column 14. A knurled nut 66 is screwed onto threaded pin 64 from the outside. Mounting plate 20 is therefore height-adjustably mounted on the support column and can be locked to support column 14 by means of knurled nut 66. Mounting plate 20 is fastened to desktop 10 in the manner described above by means of a textile adhesive closure 22, 24.

At the lower end of support column 14, resting on floor 28, a support panel 30 is provided which can for example likewise be mounted as a rectangular panel inside the angle profile of support panel 14 and whose side lengths correspond to the widths of the section legs of support column 14. Support panel 30 is fastened in the manner described above in conjunction with FIGS. 3 to 5 by means of a textile adhesive closure to floor 28. To prevent the desk from being forced away from support column 14, in the manner shown in FIG. 18, a cutout 68 can be provided in support panel 30. Leg 54 of the desk, located at the corner of support column 14, is placed in this cutout 68 in support panel 30 so that support panel 30 prevents support column 14 and desk leg 54 from sliding apart.

It is obvious that even in an embodiment of support column 14 according to FIG. 4 or FIG. 14, support panel 30 can extend to the closest leg 54 of the desk and receive this leg 54 in a cutout 68.

I claim:

1. Apparatus for fastening a vertical column subject to a lateral force to an article of furniture having a surface at an angle to the vertical, comprising:

(a) a substantially vertical column, (b) means for resisting lateral movement of said column comprising:

(i) a mounting plate for said column adjacent a surface of an article of furniture which is at an angle to the vertical, and (ii) a pair of hook and loop fasteners providing substantial resistance to shearing movement when engaged, one said fastener for securing to said article of furniture and the other secured to said mounting plate, (c) whereby lateral shearing movement and tilting movement of said column tending to tilt the mounting plate about a tilting axis at an edge thereof may be prevented.

2. The apparatus of claim 1, wherein said mounting plate extends substantially horizontally from said support column, and said surface of said article of furniture is substantial horizontal.

3. The apparatus of claim 2, wherein said mounting plate projects laterally from said support column.

4. The apparatus of claim 3, and further comprising a second pair of hook and loop fastener remote from said first pair of hook and loop fastener at a distance from said first pair of fastener, and means for fastening an element of said second pair of hook and loop fasteners to said article of furniture and the other element of said second pair of hook and loop fastener to a support, said support extending from said column.

5. The apparatus of claim 4, wherein said first mentioned element of said second pair is for fastening to a substantially vertical surface of said article of furniture and said support to which the other element of said second pair is fastened is substantially vertical.

6. The apparatus of claim 4, said means for securing said first mentioned element of said second pair of securing elements comprising means for securing said first mentioned element to an underside surface of the article of furniture.

7. The apparatus of claim 6, and further comprising means for mounting said mounting plate on said column at any one of a plurality of selected positions on said column.

8. The apparatus of claim 3, and further including a second pair of said hook and loop fasteners, one said element of said second pair of said fasteners adjoining the lower end of said column, the other element of said second pair of said fasteners adjoining the floor supporting said article of furniture.

9. The apparatus of claim 8, and further comprising a horizontal support panel at the lower end of said column, said one element of said second pair of fasteners being secured to the bottom surface thereof.

10. The apparatus of claim 9, and means for securing said mounting plate to the lower end of said column.

11. The apparatus of claim 9, and a floor plate fastened to said floor, said second element of said second pair of hook and loop fasteners mounted on the top of said floor plate.

12. The apparatus of claim 11, and further comprising textile flooring on said floor, and brush-type wires fastening said floor plate to said textile flooring.

13. The apparatus of claim 8, wherein said other element of said second pair of fasteners is mounted on said floor.

14. The apparatus of claim 1, and further comprising means for mounting said mounting plate on said column at any one of a plurality of selected positions on said column.

15. The apparatus of claim 1, said mounting plate being at the lower end of said column, and further comprising a mounting angle having substantially perpendicular portions, one portion of the mounting angle being horizontal, and means for attaching said horizontal portion to the upper surface of said mounting plate, the other portion extending substantially vertical, and a second pair of engaged fasteners, one element of said second pair attached to said vertical portion of said mounting angle, the other element of said second pair for being secured to a vertical surface of the article of furniture.

16. The apparatus of claim 15, wherein said horizontal leg of said mounting angle adjoins the top of said mounting plate.

17. The apparatus of claim 16, and means for securing said horizontal leg of said mounting angle to said mounting plate.

18. The apparatus of claim 15, wherein said mounting plate has a horizontal slot in a side thereof, said horizontal leg of said mounting angle inserted into said slot.

19. The apparatus of claim 1, said mounting plate being at the lower end of said column, and further comprising a mounting angle having horizontal and vertical legs, said horizontal leg for extending under a horizontal surface of an article of furniture and said vertical leg projecting upwardly, said mounting plate at the lower end of said column having one said element of said first pair of hoop and loop fasteners secured to the bottom surface thereof, and the second element for adjoining an upwardly facing horizontal surface of said article of furniture, an angle extending vertically downwardly from said mounting plate at the lower end of said column, a second pair of said hoop and loop fasteners secured respectively to said vertical leg of said mounting angle and to said angle extending downwardly from said mounting plate.

20. The apparatus of claim 1, wherein said column is L-shaped in cross-section at least in part, and comprises a pair of vertical legs at right angles to each other, said article of furniture having a right angle corner formed by two perpendicular sides thereof, said legs of said column for being at said corner with said legs thereof adjoining said sides of said article of furniture, said mounting plate having a right angle corner positioned inside the said legs of said vertical support column.

21. The apparatus of claim 20, and further comprising a vertical leg extending upwardly from said mounting plate, said leg of said mounting plate abutting an internal surface of said leg of said support column, and means for fastening said leg of said mounting plate to said leg of said column in any one of a plurality of selected positions vertically therealong.

22. The apparatus of claim 1, and further including a second pair of said hook and loop fasteners, one said element of said second pair of said fasteners adjoining the lower end of said column and the other element of said second pair of fasteners adjoining the floor supporting said article of furniture, said article of furniture having a leg relatively close to said support column, the lower end of said support column adjoining the floor supporting said article of furniture, and means for connecting said leg of said article of furniture with said support column.

23. The apparatus of claim 22, said connecting means comprising a panel having a cutout therein, said closest leg of said article of furniture extending into said cutout.

24. The apparatus of claim 22, and further comprising a floor engaging mat, said support column having a mounting plate at the lower end thereof to which an element of said second pair of fasteners is attached, said mat for extending beneath said mounting plate and said leg of said article of furniture.

25. The apparatus of claim 24, said mat comprising a compressible material, said mounting plate and said mat having a third pair of said hook and loop fasteners attached thereto.

26. The apparatus of claim 24, and an additional pair of hoop and loop fasteners connected to said floor and to said mat.

27. The apparatus of claim 22, a mat extending beneath said leg and beneath said column, and an additional pair of hook and loop fasteners being secured to said mat and to said floor.

28. Apparatus for fastening a vertical column subject to a lateral force to an article of furniture having a surface of an angle to the vertical, said apparatus consisting of:

(a) a substantially vertical column, (b) a mounting plate attached at the lower end of said column, and (c) a pair of interengaged hook and loop fasteners providing substantial resistance to shearing movement when engaged, one said fastener being secured to said article of furniture and the other being secured to said mounting plate.

* * * * *